United States Patent [19]

Heckaman

[11] Patent Number: 4,611,721

[45] Date of Patent: Sep. 16, 1986

[54] TIE AND BELT RACK

[76] Inventor: Curtis R. Heckaman, South Bend, Ind.

[21] Appl. No.: 598,059

[22] Filed: Apr. 9, 1984

[51] Int. Cl.[4] ..... A47F 5/08

[52] U.S. Cl. ..... 211/100; 211/99; 248/207; 248/240.4

[58] Field of Search ..... 211/100, 168, 171, 99; 248/222.2, 224.3, 240.4, 207; 403/116, 91

[56] References Cited

U.S. PATENT DOCUMENTS 3,120,940 2/1964 Del Faro et al. ..... 248/207

FOREIGN PATENT DOCUMENTS 316768 8/1929 United Kingdom ..... 211/99

1156145 6/1969 United Kingdom ..... 211/99

*Primary Examiner*—J. Franklin Foss

*Assistant Examiner*—Blair Johnson

*Attorney, Agent, or Firm*—James D. Hall

[57] ABSTRACT

A storage rack for articles of clothing or accessories such as ties and belts which may be mounted to a wall or ceiling. The rack includes an arm pivotable with respect to a mounting bracket between vertical storage and horizontal operative positions.

2 Claims, 8 Drawing Figures

TIE AND BELT RACK

SUMMARY OF THE INVENTION

This invention relates to a storage rack for articles of clothing and will have special application to a tie and belt rack.

The storage rack of this invention is adapted to be mounted to a wall, ceiling, shelf or door. The rack includes an arm member having a series of pegs for supporting a plurality of ties or belts. The arm is pivotally fastened to a slotted mounting bracket and may be pivoted from a vertical storage position into an operative horizontal position with the mounting bracket being attached in either a vertical or horizontal orientation. Due to its adjustability, the tie rack is an attractive space saver which allows a person to select or replace a tie or belt rapidly without removing or disturbing the other ties and belts on the rack.

Accordingly, it is an object of this invention to provide for a novel storage rack for clothing and accessories. Another object of this invention is to provide for a tie, belt or jewelry rack which is adjustable.

Another object of this invention is to provide for a tie or belt rack which is efficient and economical.

Other objects will become apparent upon a reading of the following description.

BRIEF DESCRIPTION OF THE DRAWINGS

A preferred embodiment of the invention has been chosen to explain the principles thereof wherein.

DESCRIPTION OF THE PREFERRED EMBODIMENT

Figure 1:
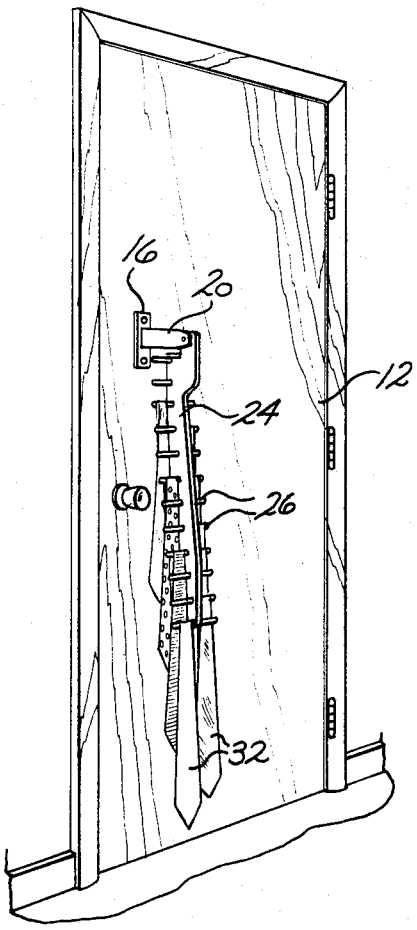
FIG. 1 is a perspective view of the rack shown in its storage position and mounted to a door.
Figure 2:
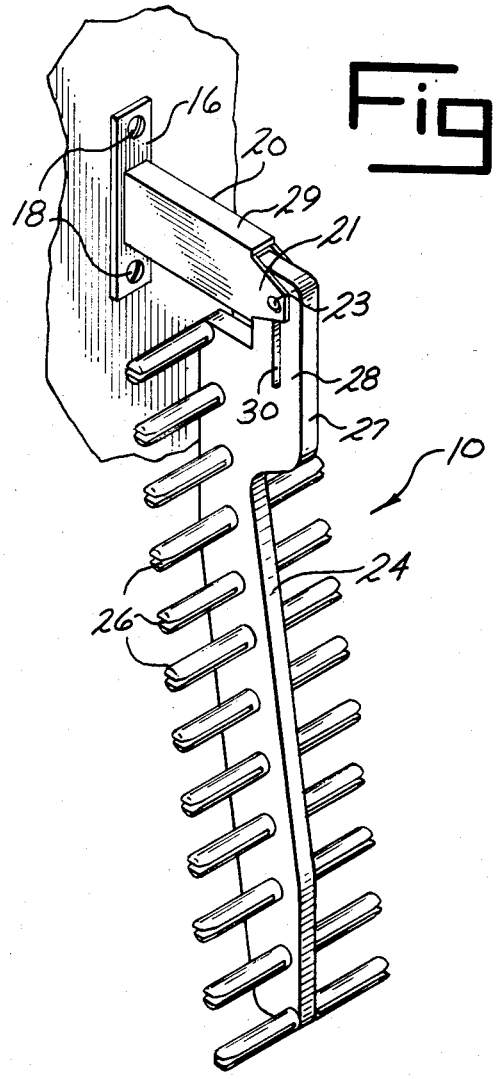
FIG. 2 is a perspective view of the rack in its storage position.
Figure 3:
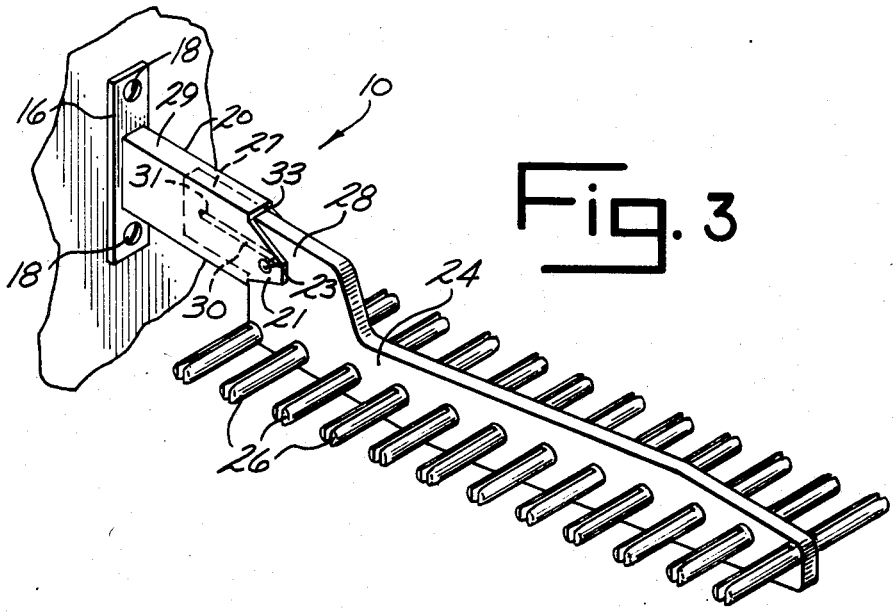
FIG. 3 is a perspective view of the rack in its operative position.
Figure 4:
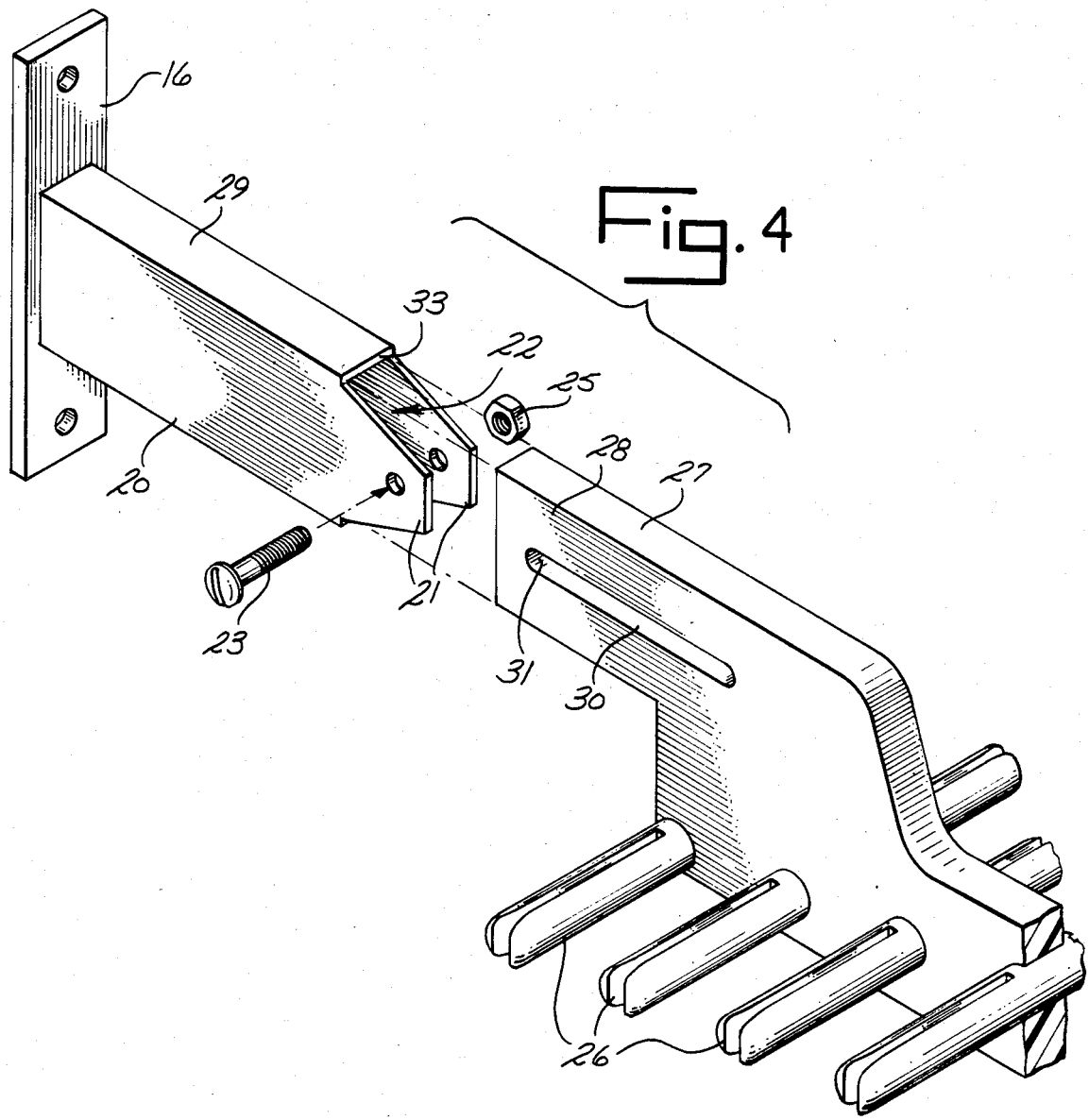
FIG. 4 is a fragmentary exploded view of the rack.
Figure 5:
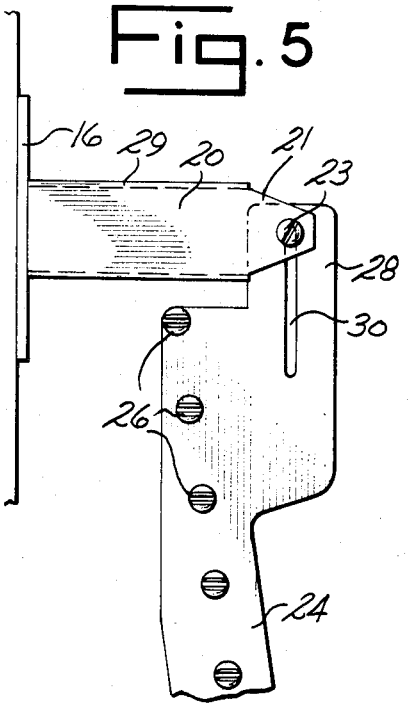
FIG. 5 is a fragmentary elevational view of the rack in its storage position.
Figure 6:
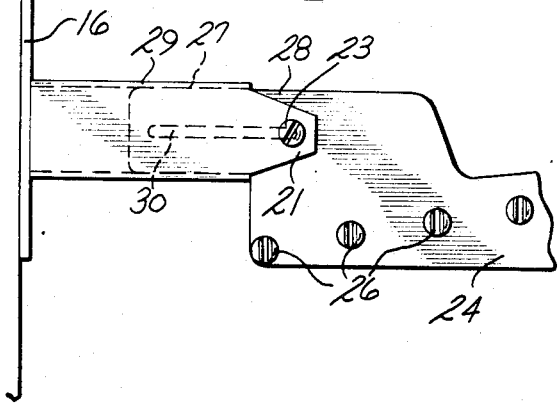
FIG. 6 is a fragmentary elevational view of the rack in its operative position.

The preferred embodiment herein described is not intended to be exhaustive or to limit the invention to the precise form disclosed. It is chosen and described to explain the principles of the invention and its application and practical use to thereby enable others skilled in the art to utilize the invention.

The rack 10 shown in the drawings is adapted for mounting to a side wall or door 12, or alternatively to a ceiling or other overhead support 14. Rack 10 includes a mounting bracket 16 which is fastened to door 12 (FIGS. 1–6) or ceiling 14 (FIGS. 7 and 8) by conventional fasteners such as screws 18. Bracket 16 includes a tubular frame 20 having a central opening 22. The free end of frame 20 is slotted and formed into spaced tabs 21. A pivot pin 23 extends transversely through frame tabs 21 and is held in place by a nut 25. Rack 10 also includes an arm 24 having a series of laterally extending pegs 26. One end 28 of arm 24 includes a longitudinally extending slot 30.

As shown in FIGS. 1–6, tie rack 10 may be used while mounted to a side support such as door 12. As shown in FIG. 1, pegs 26 serve to support a plurality of ties 32. To select or replace a tie 32, a person grasps arm 24 and pivots the arm upwardly, and then inserts arm end 28 into frame opening 22 for the length of slot 30. When arm end 28 is so inserted, the upper edge 27 of arm end 28 contacts the upper wall 29 of frame 20 to secure arm 24 against downward pivotal movement about pin 23. Ties 32 may then be easily selected or replaced from pegs 26. To return rack 10 to its storage position, arm 24 is pulled outwardly for the length of slot 30 or until the end 31 of slot 30 contacts pivot pin 23. Arm 24 is then pivoted about pin 23 and lowered into the storage position shown in FIG. 2.

Figure 7:
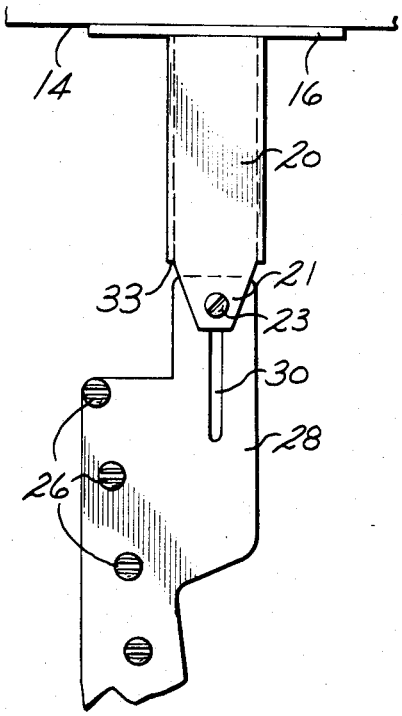
FIG. 7 is a fragmentary elevational view of the rack shown in its storage position and mounted to an overhead support.
Figure 8:
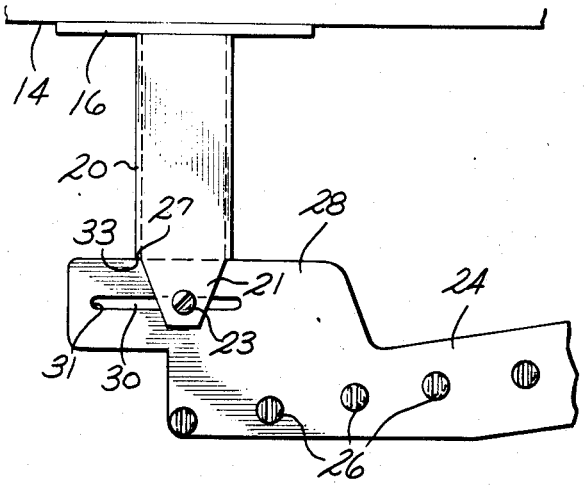
FIG. 8 is a fragmentary elevational view of the rack of FIG. 7 shown in its operative position.

FIGS. 7 and 8 show the rack 10 as mounted to an upright support such as ceiling 14. As shown in FIG. 7, rack arm 24 hangs vertically from pivot pin 23 when in the storage position. To select or replace a tie, arm 24 is pivoted upwardly about pin 23 at slot end 31 until it is substantially perpendicular to frame 20. Arm 24 is then shifted transversely relative to frame 20 along slot 30 into the position shown in FIG. 8 with edge 27 of the arm being located under end edge 33 of frame 20. Arm upper edge 27 contacts one of frame end edges 33 to support arm 24 in its operative cantilevered position. To place arm 24 in its storage position, the arm is slightly lifted and pulled laterally until frame pin 23 contacts the end 31 of arm slot 30. This allows the arm to be pivoted downwardly without contacting frame end edge 33.

It is to be understood that the scope of the invention is not limited to the above description, but may be modified within the scope of the appended claims.

I claim:

1. A storage rack for clothing and accessories comprising a bracket adapted for mounting to a support, and an arm having projection means for supporting an article of clothing or accessory, said bracket having spaced side walls and spaced end walls defining a tubular opening, said bracket end walls each terminating in an end edge at said bracket opening, said bracket side walls including tabs extending forwardly of said bracket opening and end wall end edges, a pin extending through said tabs across said bracket opening, said arm including a transverse slot at one end portion thereof, said pin extending through said arm slot, said arm being shiftable about said pin from a storage position wherein said arm hangs by said pin generally vertically from said bracket means, and first and second operative positions wherein said arm is supported by said pin in a generally horizontal orientation, said arm in its said first operative position having its said one end portion extending into said bracket opening and contacting one of said bracket end walls when said bracket projects horizontally from said support, said arm in its said second operative position having its said one end portion extending across said bracket opening and contacting one of said bracket end wall end edges when said bracket projects vertically from said support.

2. The clothing storage rack of claim 1 wherein said pin contacts an end edge of said arm slot when the arm is in its said storage position and said pin is spaced from said slot end edge when in the said first or second operative positions.

* * * * *